US006320490B1

(12) United States Patent
Clayton

(10) Patent No.: US 6,320,490 B1
(45) Date of Patent: Nov. 20, 2001

(54) INTEGRATED PLANAR TRANSFORMER AND INDUCTOR ASSEMBLY

(75) Inventor: Paul Clayton, Santa Clara, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/374,316

(22) Filed: Aug. 13, 1999

(51) Int. Cl.[7] ..... H01F 27/28

(52) U.S. Cl. ..... 336/180; 336/84 R; 336/198; 336/170; 336/200; 336/232

(58) Field of Search ..... 336/200, 232, 336/170, 180, 182, 183, 198, 84 R

(56) References Cited

U.S. PATENT DOCUMENTS 3,611,232 * 10/1971 Sakamoto et al. ..... 336/170
4,549,130 * 10/1985 Dobberstein ..... 338/82
4,689,592 * 8/1987 Walker ..... 336/83
5,319,342 * 6/1994 Kuroki ..... 336/170
5,659,461 * 8/1997 Inou et al. ..... 363/21
5,731,740 * 3/1998 Van De Westerlo ..... 330/276

* cited by examiner

*Primary Examiner*—Lincoln Donovan
*Assistant Examiner*—Tuyen Nguyen
(74) *Attorney, Agent, or Firm*—Kenneth W. Float

(57) ABSTRACT

An integrated transformer and inductor assembly for use in soft switching or resonant power converters, and the like. The assembly has a planar structure and includes a planar transformer and a parallel inductor. The assembly has a transformer core with a central gap. Planar interleaved primary and secondary winding are separated by insulating layers and are disposed within the transformer core. The parallel inductor is provided by a concentric inductor (reactive) winding disposed adjacent the center of the transformer core, which may be wound around a bobbin. The concentric inductor (reactive) winding carries inductor current, while load current flows mostly in the planar windings. Loss due to magnetizing current is substantially reduced in the present invention.

7 Claims, 2 Drawing Sheets

INTEGRATED PLANAR TRANSFORMER AND INDUCTOR ASSEMBLY

BACKGROUND

The present invention relates generally to planar transformers used in soft switching and resonant power converters, and more particularly, to an integrated planar transformer and inductor assembly for use in soft switching and resonant power converters.

FIG. 1 illustrates a typical conventional planar transformer 10 used in soft switching and resonant power converters in which the inductive element of the resonant circuit is connected in parallel with a transformer. In such circuits, it is convenient to use the magnetizing inductance of the transformer 10 as the inductive element of the resonant circuit. Such conventional planar transformers 10 typically have a core 11 with a central gap 12 that surrounds planar interleaved primary and secondary windings 13, 14 or layers. The gap thickness is set to yield the necessary value of the magnetizing inductance for proper circuit operation. The interleaved primary and secondary rings 13, 14 are separated by insulating (dielectric) layers 15.

In such conventional planar transformers, the magnetizing (inductor) current in the secondary winding 14 crowds to the inside of the winding (current crowding 16), mostly within one skin depth of the innermost path in the planar structure of the planar transformer 10. This greatly increases the loss caused by the inductor current, due to the limited cross section carrying current.

Accordingly, it is an objective of the present invention to provide for an improved integrated planar transformer and inductor assembly for use in soft switching and resonant power converters that overcomes the limitations of conventional planar transformers by reducing the additional loss caused by the inductor current.

SUMMARY OF THE INVENTION

To accomplish the above and other objectives, the present invention provides for an integrated transformer and inductor assembly for use in soft switching or resonant power converters, and the like. The present invention has a planar structure and comprises a planar transformer and a parallel inductor. The parallel inductor is provided by a concentric inductor (reactive) winding located adjacent the center of the transformer core.

In the present invention, the concentric inductor (reactive) winding carries inductor current, while load current flows in the planar windings. Loss due to magnetizing current is substantially reduced in the present invention.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 2:
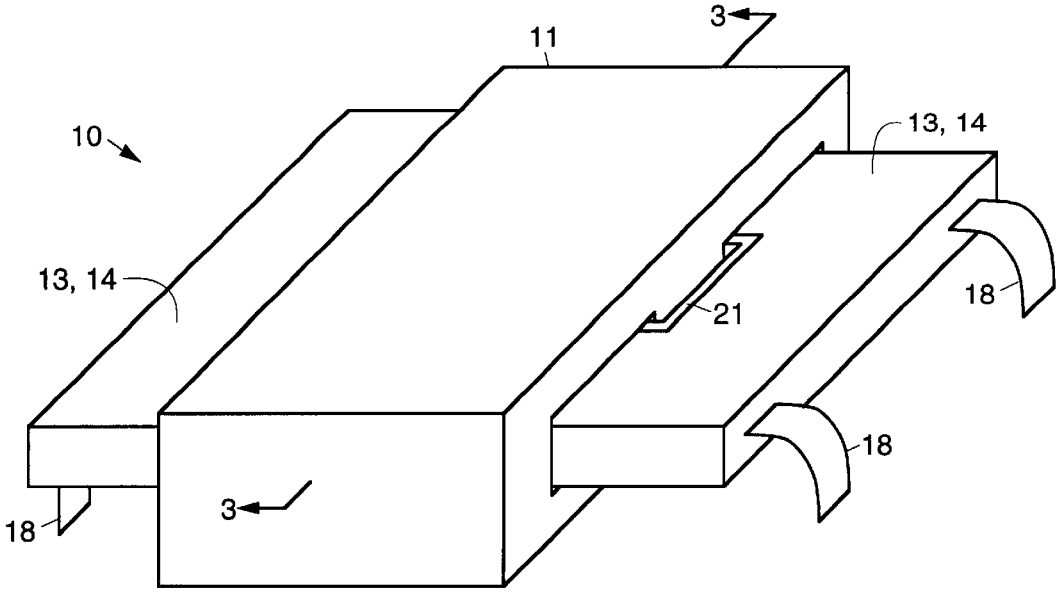
FIG. 2 is a perspective view of a first exemplary integrated transformer and inductor assembly in accordance with the principles of the present invention.
Figure 3:
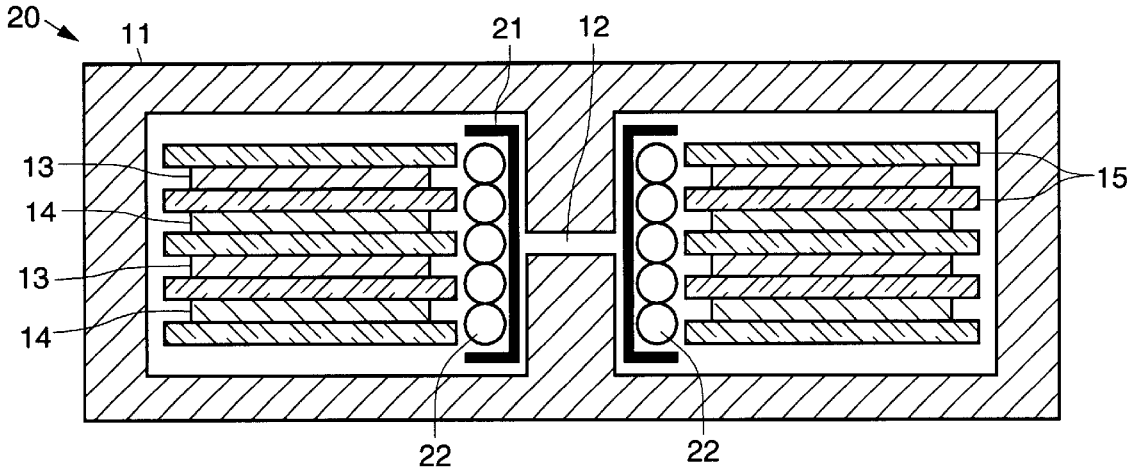
FIG. 3 illustrates a cross sectional view of the exemplary integrated transformer and inductor assembly of FIG. 2.
Figure 4:
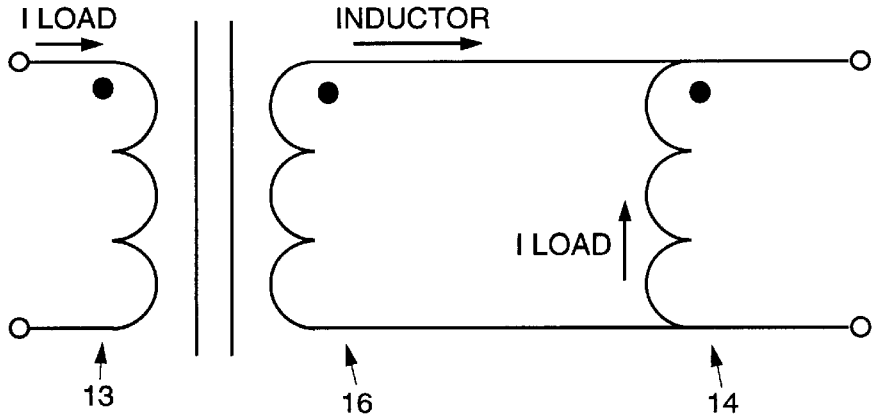
FIG. 4 is a schematic magnetic diagram of the exemplary integrated transformer and inductor assembly.

Referring again to the drawing figures, FIG. 2 illustrates a perspective view of an exemplary integrated transformer and inductor assembly 20 in accordance with the principles of the present invention. FIG. 3 illustrates a cross sectional view of the exemplary integrated transformer and inductor assembly 20 of FIG. 2 taken along the lines 3—3.

Referring to FIGS. 2 and 3, the exemplary integrated transformer and inductor assembly 20 comprises a core 11 having a central gap 12 that surrounds planar interleaved primary and secondary windings 13, 14 or layers 13, 14. The interleaved primary and secondary windings 13, 14 are separated by insulating (dielectric) layers 15.

Figure 5:
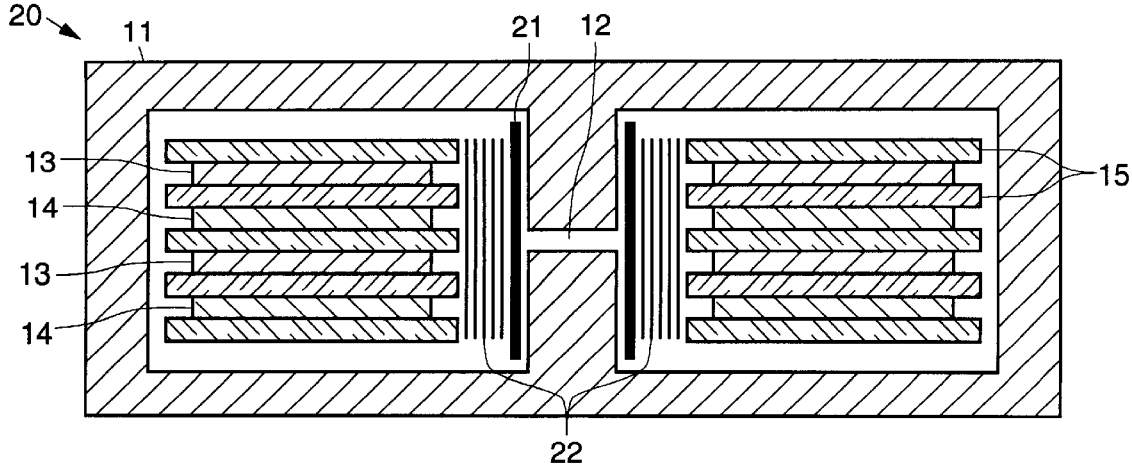
FIG. 5 illustrates a second exemplary embodiment of the integrated transformer and inductor assembly in accordance with the principles of the present invention using sheet windings.

A bobbin 21 may be provided adjacent the center of the core 11 around which a concentric inductor (reactive) winding 22 or wire 22 is wound. The concentric inductor (reactive) winding 22 is connected in parallel with the secondary winding 14. This is illustrated in FIG. 5, which is a schematic diagram of a second exemplary embodiment of the integrated transformer and inductor assembly 20 employing a sheet winding 22. This particular realization of the invention is suitable for current fed converters, whose transformer magnetizing current flows in the secondary winding. For voltage fed converters, in which the transformer magnetizing current flows in the primary winding, the inductor winding should be connected in parallel with the primary.

The gap 12 in the transformer core 11 of the integrated transformer and inductor assembly 20 reduces the magnetizing inductance and allows the integrated transformer and inductor assembly 20 to serve as an inductive element in an LC resonant circuit. Magnetizing current flows mostly within one skin depth of the surface of the secondary winding 14 that are adjacent to the core 11 because this is the lowest magnetizing inductance path. The load current transferred between the primary and secondary windings 13, 14 flows mostly in the planar windings 13, 14, because the primary winding 13 to secondary winding 14 leakage inductance is lowest in those windings 13, 14.

Figure 1:
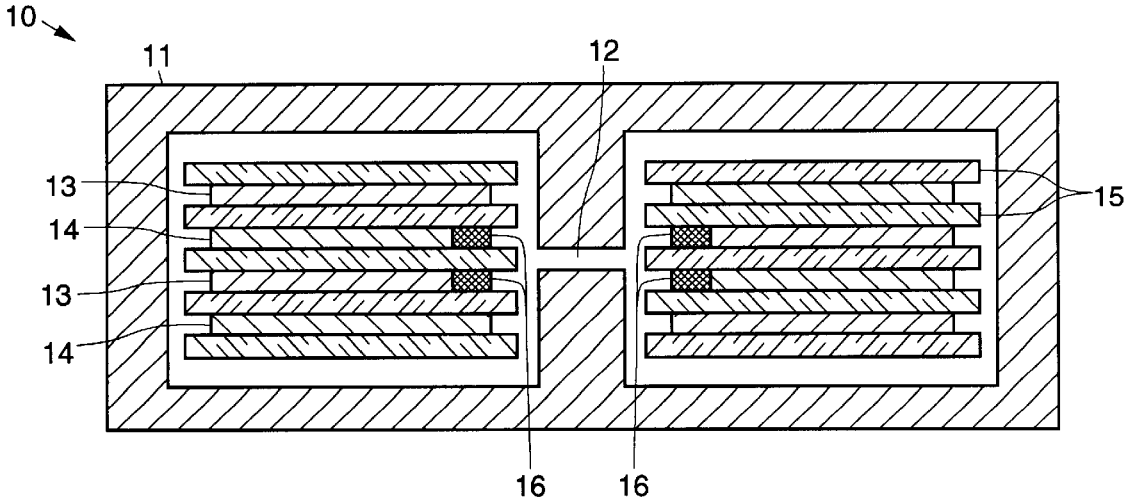
Fig. 1 (PRIOR ART)
FIG. 1 illustrates current crowding in a conventional planar transformer.

If the inner concentric inductor (reactive) winding 22 was not present, the structure would be similar to a conventional planar transformer, such as is shown in FIG. 1. As was mentioned above, the magnetizing (inductor) current in the secondary winding 14 of the conventional planar transformer 10 crowds to the inside of the winding 14, mostly within one skin depth of the innermost path in the planar structure. This greatly increases the loss caused by the magnetizing (inductor) current, due to the limited cross section carrying current.

In accordance with the present invention, the addition of the inner concentric inductor (reactive) winding 22, wound entirely at the innermost surface of the primary and secondary windings 13, 14, and connected in parallel with the secondary winding 14, increases the cross section (of the secondary winding 14) within approximately one skin depth of its inner surface, reduces AC resistance, and therefore loss due to the inductive current.

Loss can be further reduced by winding the inner concentric winding in several layers, with each layer being less than one skin depth thick. This allows the effective cross section to be increased. A multiple layer winding may be constructed using wire, or as a sheet winding as shown in FIG. 5, where the number of layers equals the number of turns. The optimum total conductor thickness of the inductor winding increases with the number of layers used, being 1 to 1.5 skin depths for a single layer winding and about 3 skin depths for a ten layer winding.

Thus, an improved integrated transformer and inductor assembly for use in soft switching or resonant power converters, and the like, has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. An integrated transformer and inductor assembly comprising:

a transformer core having a central gap; (PA)

planar interleaved primary and secondary winding separated by insulating layers disposed within the transformer core; and (PA)

a concentric inductor winding disposed adjacent the center of the core between the core and the primary and secondary windings, which surrounds a substantial portion of the central core and the central gap, and which is connected in parallel with the primary or secondary windings.

2. The assembly recited in claim 1 wherein concentric inductor winding is wound around a bobbin.

3. The assembly recited in claim 1 wherein the concentric inductor winding is wound entirely at innermost surfaces of the primary and secondary windings.

4. The assembly recited in claim 1 wherein the concentric inductor winding increases the cross section of the secondary winding within several skin depths of its inner surface, reduces AC resistance, and reduces loss due to the inductive current.

5. An integrated transformer and inductor assembly comprising:

a transformer core having a central gap;

planar interleaved primary and secondary winding separated by insulating layers disposed within the transformer core;

a bobbin disposed around the center of the core; and a concentric inductor winding wound around the bobbin that is disposed between the core and the primary and secondary windings, which surrounds a substantial portion of the central core and the central gap, and which is connected in parallel with the primary or secondary windings.

6. The assembly recited in claim 5 wherein the concentric inductor winding is wound entirely at innermost surfaces of the primary and secondary windings.

7. The assembly recited in claim 5 wherein the concentric inductor winding increases the cross section of the secondary winding within several skin depths of its inner surface, reduces AC resistance, and reduces loss due to the inductive current.

* * * * *